US005819776A

United States Patent [19]

Kephart

[11] Patent Number: 5,819,776

[45] Date of Patent: Oct. 13, 1998

[54] LIQUID DE-ICER PRODUCTION APPARATUS AND METHOD

[76] Inventor: Edward L. Kephart, 2550 Reubin's La., Farwell, Minn. 56327

[21] Appl. No.: 744,355

[22] Filed: Nov. 6, 1996

[51] Int. Cl.[6] ..... B01D 11/02

[52] U.S. Cl. ..... 137/1; 137/265; 137/268; 137/576; 422/261

[58] Field of Search ..... 137/268, 571, 137/576, 594, 861, 883, 1, 255, 262, 264, 265; 422/261, 264, 278, 282; 222/424.5, 443; 220/501

[56] References Cited

U.S. PATENT DOCUMENTS

| | | | |
|---|---|---|---|
| 2,122,900 | 7/1938 | Uhrmacher | 422/261 X |
| 2,280,466 | 4/1942 | Black . | |
| 2,281,140 | 4/1942 | Courthope et al. | 422/261 |
| 2,378,134 | 6/1945 | Evans . | |
| 2,576,315 | 11/1951 | Swartz . | |
| 3,307,914 | 3/1967 | Heiss et al. . | |
| 3,372,995 | 3/1968 | Ryan . | |
| 3,578,776 | 5/1971 | Schneider et al. . | |
| 3,684,457 | 8/1972 | Pinto et al. | 422/278 X |
| 3,770,198 | 11/1973 | Mihara . | |
| 3,800,026 | 3/1974 | Morgan | 422/261 X |
| 3,968,932 | 7/1976 | Kimmell | 137/268 X |
| 4,116,640 | 9/1978 | Leverenz . | |
| 4,379,125 | 4/1983 | Benninger et al. . | |
| 5,332,312 | 7/1994 | Evanson . | |
| 5,335,690 | 8/1994 | Worth . | |
| 5,419,355 | 5/1995 | Brennan et al. . | |

*Primary Examiner*—Kevin Lee
*Attorney, Agent, or Firm*—Haugen & Nikolai, PA

[57] ABSTRACT

The present invention is an apparatus and method for producing a salt solution suitable for use as a liquid ice and snow remover. The apparatus consists of an internal dual-tank arrangement. The exterior walls of the apparatus form an outer containment tank which holds preferably up to 110% of the volume of the internal dual-tank arrangement. The dual-tank arrangement consists of a hopper tank for holding a soluble salt and a holding tank for holding the produced salt solution. A fluid passageway leads from the hopper tank to the holding tank. Water is fed into the lower portion of the hopper tank. It rises through salt or calcium magnesium acetate pellets located in the hopper tank forming a salt solution. The solution flows through two screened outlets into pipes which lead it to the holding tank. Fresh water is introduced into the salt solution as it exits the hopper tank and enters the holding tank. The amount of water introduced into the salt solution as it exits the hopper tank is adjusted depending upon the amount of salinity present in the solution flowing from the hopper tank. Once the holding tank is full, the salt solution may be removed from the holding tank for use as a snow and ice remover.

18 Claims, 5 Drawing Sheets

LIQUID DE-ICER PRODUCTION APPARATUS AND METHOD

I. FIELD OF THE INVENTION

The present invention relates generally to an apparatus and method for dissolving a chemical in a liquid and more particularly for dissolving rock salt or calcium magnesium acetate (CMA) pellets in water for producing a salt solution to be used as a liquid de-icer.

II. BACKGROUND OF THE INVENTION

Chemical solutions formed by dissolving a solid chemical in a liquid have been used in a variety of industrial applications, including the use of a salt solution for melting and removal of snow and ice from sidewalks, driveways, roadways, runways and the like. These solutions may be generally created by directing a liquid through an amount of the chemical to be dissolved, such as rock salt or CMA pellets, to produce the solution and then removing the solution with the desired saturation level.

U.S. Pat. No. 3,372,995 to Ryan is an example of a basic apparatus for producing a brine solution to be used to melt snow and ice. Water is drawn into the bottom of a container of rock salt where it rises in the container and is then drawn out of an outlet located near the top of the container.

Another type of this process can be found in U.S. Pat. No. 5,419,355 to Brennan et al. which produces a solution by directing water through a columnar container of calcium hypochlorite pellets. Water enters at the bottom of the container and rises to a predetermined level before it is removed though an outlet located in the container side or siphoned out through the bottom of the container. The concentration of this solution is preferably between 2 and 18 percent and is adjusted by altering the rate of water flowing into the container or the level in the container to which the water rises before being removed.

A similar approach introduces water at the bottom of a container holding rock salt or the like chemical pellets. An outlet is located below the level of the rock salt or the like chemical pellets and water in the container. U.S. Pat. No. 5,335,690 to Worth, U.S. Pat. No. 4,379,125 to Benninger and U.S. Pat. No. 4,116,640 to Leverenz are examples of this approach.

Other prior art processes introduce water at the top of a container holding the chemical pellets or the like and allow the water drain through the container. Outlets are located on the bottom of the container for removing the resulting solution. U.S. Pat. No. 5,332,312 to Evanson discloses an example of this approach.

The ability to adjust the concentration of the solution as it exits the dissolving container is not shown in the prior art. While several of prior art approaches provide ways to manipulate the water flow or level in the container to adjust the concentration, these approaches do not fine tune the concentration after the solution has been produced.

It is accordingly a principal object of the present invention to provide a system for making a salt solution by introducing water at the bottom of a dissolving container containing the chemical to be dissolved, such as rock salt or CMA pellets, allowing the water to flow upward through the dissolving container to an overflow outlet where additional fresh water can be introduced prior to the solution entering a holding tank to adjust the solution's concentration.

Another object of the present invention is to provide a system for producing a liquid de-icer which includes a feature for introducing fresh water into a salt solution for fine tuning the salt concentration of the solution just prior to the solution entering a holding tank.

A further object of the present invention is to provide a multi-aperture manifold at the bottom of a dissolving container for uniformly introducing fresh water to prevent tunneling of the water through the chemical particles or pellets to be dissolved.

Yet another object of the present invention is to provide a valve for automatically shutting off the water infeed when the level of solution in the holding tank exceeds a predetermined level, with the holding tank having a double wall for secondary confinement of the salt solution.

SUMMARY OF THE INVENTION

The present invention is an apparatus and method for producing a chemical solution to be used for spraying roadways, sidewalks, driveways and runways to melt snow and ice. The apparatus consists of a double wall tank with an internal dual-tank structure having a hopper tank in which the salt solution is produced and a holding tank for storing the salt solution prior to its use. The outer wall of the apparatus forms an outer containment tank which can hold up to 110% of the volume found in both the hopper tank and the holding tank.

Rock salt or calcium magnesium acetate (CMA) pellets are dumped into the hopper tank at the top of the dual-tank structure. Fresh water is introduced into the hopper tank through a pipe leading to a multi-apertured manifold. The manifold is located proximate the base of the hopper tank. The level of water rises through the rock salt or CMA pellets until it exits two screened openings located at the top of the dissolved hopper tank. The liquid solution flows through screened openings leading to overflow pipes. The pipes direct the solution into a holding tank disposed adjacent the hopper. A provision is made to introduce the fresh water into the outlet conduits through which the salt solution flows from the hopper tank to the holding tank. This allows production of a predetermined percentage of salt in the solution that has been determined to be optimum for melting snow and ice. Preferably, this percentage is a 23.3% by weight or 85% by volume concentration.

A motor driven pump contained within the holding tank is used to pump the salt solution from the holding tank to a tank truck used in spreading the salt solution on roadways, sidewalks, driveways, runways or the like. A switch automatically controls the introduction of fresh water into the hopper tank so that it does not overflow the holding tank.

IN THE DRAWINGS

The foregoing features, objects, and advantages of the present invention will become apparent to those skilled in the art from the following detailed description of the preferred embodiment, especially when considered in conjunction with the accompanying drawings in which.

DESCRIPTION OF THE PREFERRED EMBODIMENT

Figure 1:
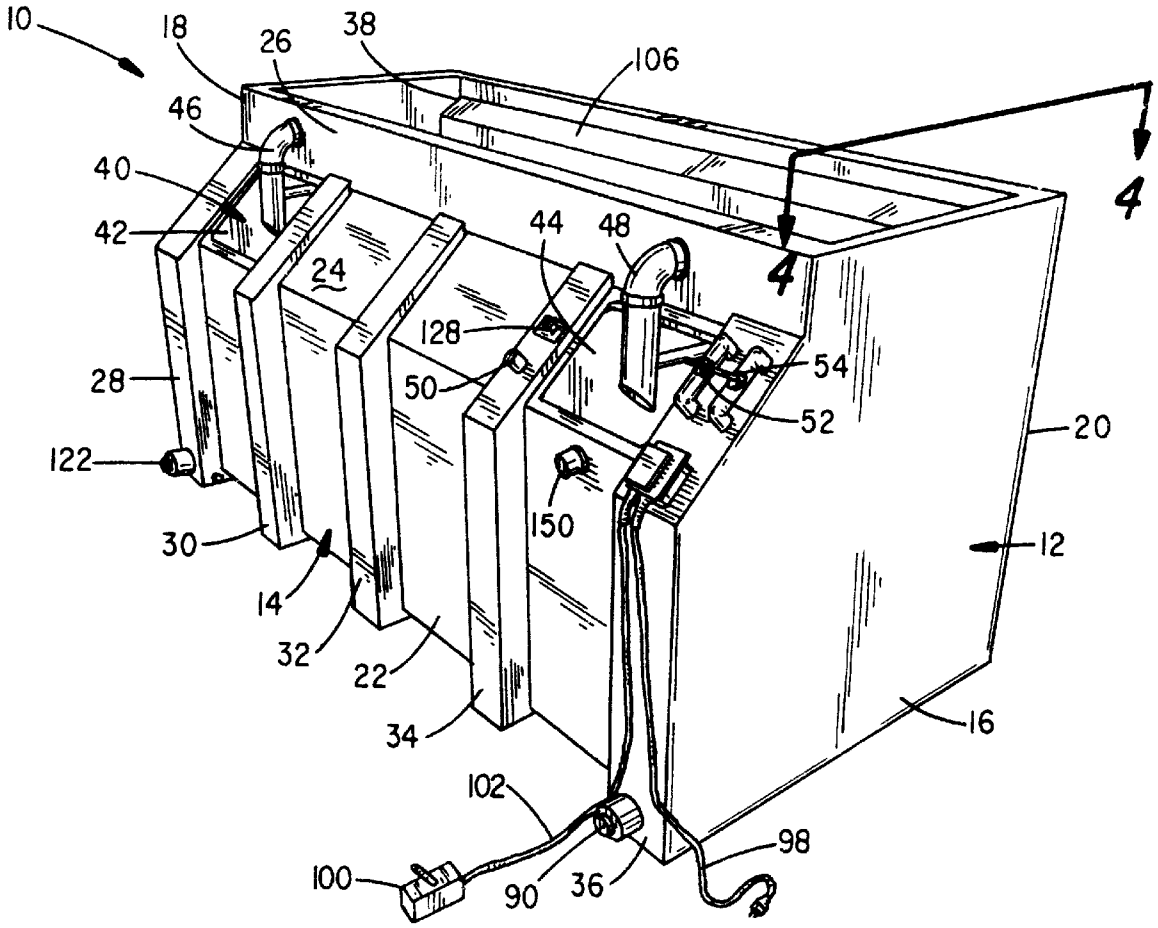
FIG. 1 is a perspective front view of the cabinet of the present invention.
Figure 4:
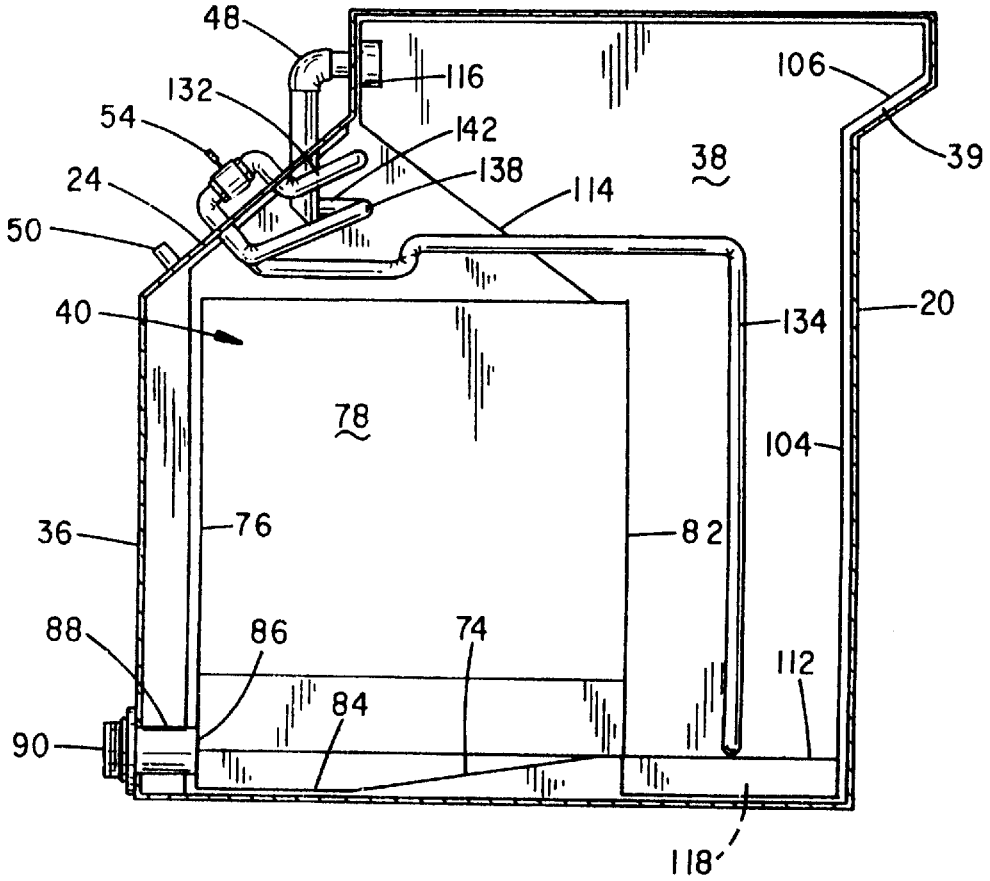
FIG. 4 is a cross-sectional view of the cabinet taken along line 4—4 in FIG. 1 and showing the interior of the confinement tank and dual-tank structure.

The present invention is a apparatus and method for producing a liquid snow and ice remover, and is designated generally as 10 in FIG. 1. The apparatus consists of a cabinet 12 forming a double walled, internal dual-tank device with the exterior walls defining a containment tank as seen in FIG. 4. The exterior of the apparatus will first be described. The cabinet has a front wall 14, side walls 16 and 18 and rear wall 20. The front wall 12 has a lower panel 22, a sloped panel 24 and a upper panel 26. The front wall additionally includes five structural ribs 28, 30, 32, 34 and 36.

The cabinet 12 contains a hopper tank 38 with an open top and a solution holding tank 40, both made out of a suitable plastic material. The holding tank 40 includes openings 42 and 44 located in the sloped front panel 24. Two overflow pipes 46 and 48 made from a suitable plastic material, extend from the hopper tank into the openings 42 and 44 of holding tank 40. The hopper tank 38 holds the rock salt or CMA pellets during production of the solution and the overflow pipes 46 and 48 direct the solution into the holding tank 40. A main water in-feed 50 is located on the front of cabinet 12. A water source (not shown) is coupled to this infeed 50 to provide water to the cabinet 12. A water infeed control valve 52 is located on the front panel along with a solution dilute control valve 54 which will be explained further in greater detail.

Figure 2:
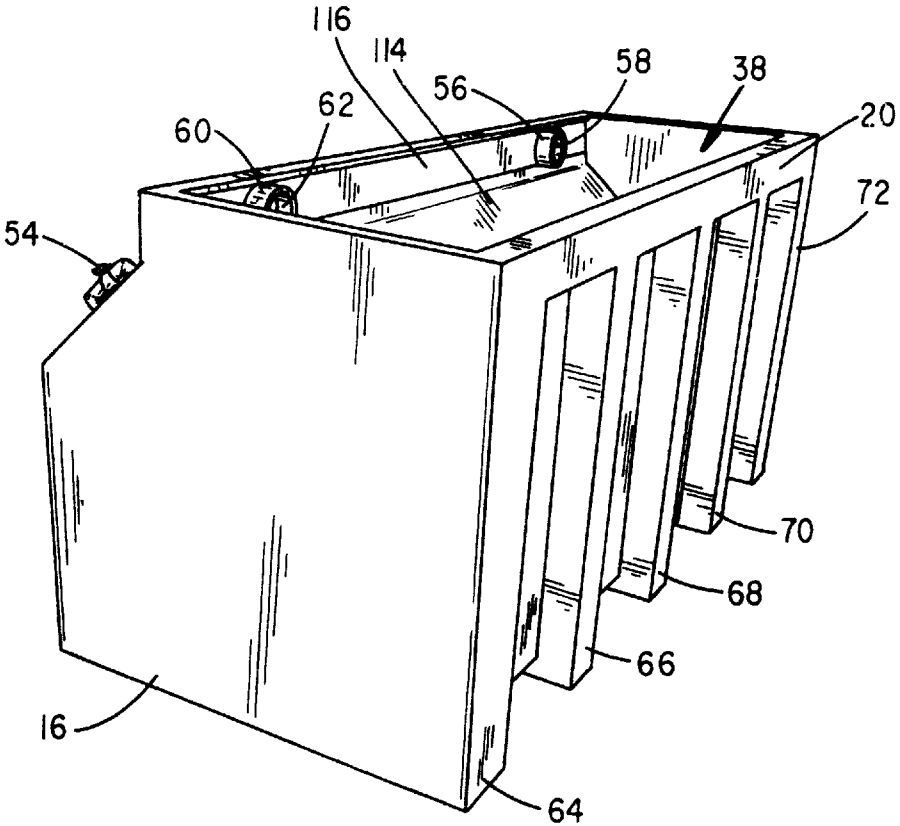
FIG. 2 is a perspective rear view of the cabinet of the present invention.

Turning now to FIG. 2, the rear of cabinet 12 can be seen. The opening 56 leading to the overflow pipe 46 contains a metal screen 58. Likewise, opening 60 leading to overflow pipe 48 contains a metal screen 62. The screens 58 and 62 are preferably removable stainless steel screens which will be used to filter out heavy sediment and prevent the heavy sediment from entering the holding tank 40. The rear wall 20 of the cabinet, like the front wall 14, contains five structural ribs 64, 66, 68, 70 and 72.

The exterior walls 14, 16, 18 and 20 of cabinet 12 define a containment tank 39 with interior walls forming the hopper tank 38 and holding tank 40. The interior of the cabinet showing the containment tank 39 and the dual-tank arrangement 38 and 40 can be seen in FIGS. 3 and 4. The containment tank 39 preferably holds approximately 110% of the holding tank 40 and hopper tank 38 volumes in the event of a broken or cracked holding tank 40 or hopper tank 38.

The holding tank 40 is generally rectangular and smaller in size than the hopper tank 38. Holding tank 40 has a base 74, a front wall 76, side walls 78 and 80 and a rear wall 82. The base of the holding tank includes a lower sump area 84. Approximate the sump area is a drain pipe 88. The drain pipe 88 includes a threaded plug 90. Located proximate the sump area is pump 92 which is preferably a conventional stainless steel submersible sewage effluent ejector pump. Pump 92 is used for pumping the solution from the holding tank 40 into a truck (not shown) through a discharge quick connect line 94. The pump 92 and discharge line 94 are adjustable via height by means of rubber slip coupling 96 in the event of sludge build-up on the main tank. The pump 92 is coupled to a power source via an electrical cord 98 extending from the front panel 24 of the cabinet 12. The pump 92 is controlled with a remote power switch 100 which preferably extends from the cabinet 12 with a 20 foot cord 100 to allow an operator to hold the switch 100 when conducting the filling operation of a truck for holding the solution.

Figure 5:
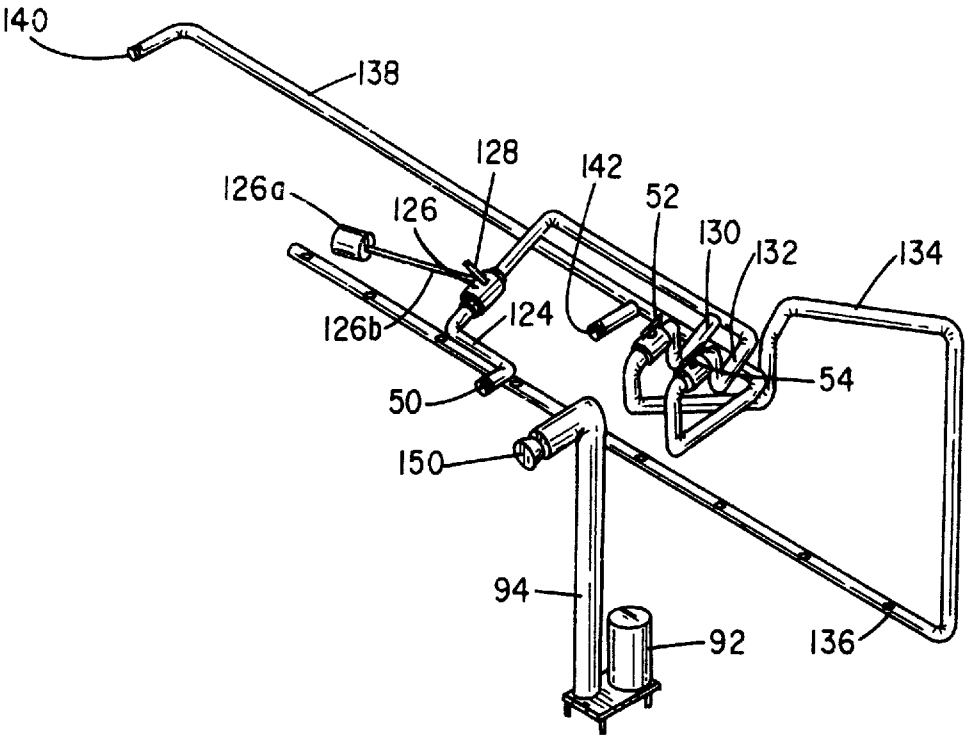
FIG. 5 is a view of the plumbing used in the present invention.

The hopper tank 38 is positioned in the rear of the cabinet 12. The hopper tank 38 has a rear wall 104 that slants outwards at its upper most portion 106, sidewalls, one of which is 108 in FIG. 3 and a base 112. A portion of its front wall shares wall 82 with the holding tank 40. Above wall 82 is an intermediate portion 114 which slants outward and over the holding tank 40 and an upper portion 116 as seen in FIGS. 2 and 4. The upper portion 116 contains ports 56 and 60 to the overflow pipes 46 and 48. The hopper base 112 also contains a lower sump area 118 for complete drainage of the hopper tank 38 contents through a hopper drain pipe 120 which runs along the side of the holding tank 40 as seen in FIG. 5. This drain pipe 120 is fitted with a threaded plug 122.

Turning now to FIG. 5, the plumbing of the present invention will be described in greater detail. The water source is coupled to the water infeed 50 which is the port of the water inlet pipe 124. Pipe 124 passes through a valve 126 which is either conventional non-electric hydraulic diaphragm control valve (shown in FIG. 3) or a hydraulic float valve (shown in FIG. 4). Inlet pipe 124 then divides into pipes 130 and 132. The first pipe 130 is coupled to the water in-feed valve 52 located on the front panel. When valve 52 is opened, water flows through a fresh water line 134 into the hopper tank 38 to the multi-apertured manifold 136 located proximate the base 112 of hopper tank 38. This manifold is preferably made from a suitable plastic material. The second pipe 132 is coupled to the solution dilute control valve 54. When valve 54 is opened, water enters the dilution line 138. The dilution line 138 feeds water into the overflow pipe 46 via port 140 and into overflow pipe 48 via port 142.

Figure 3:
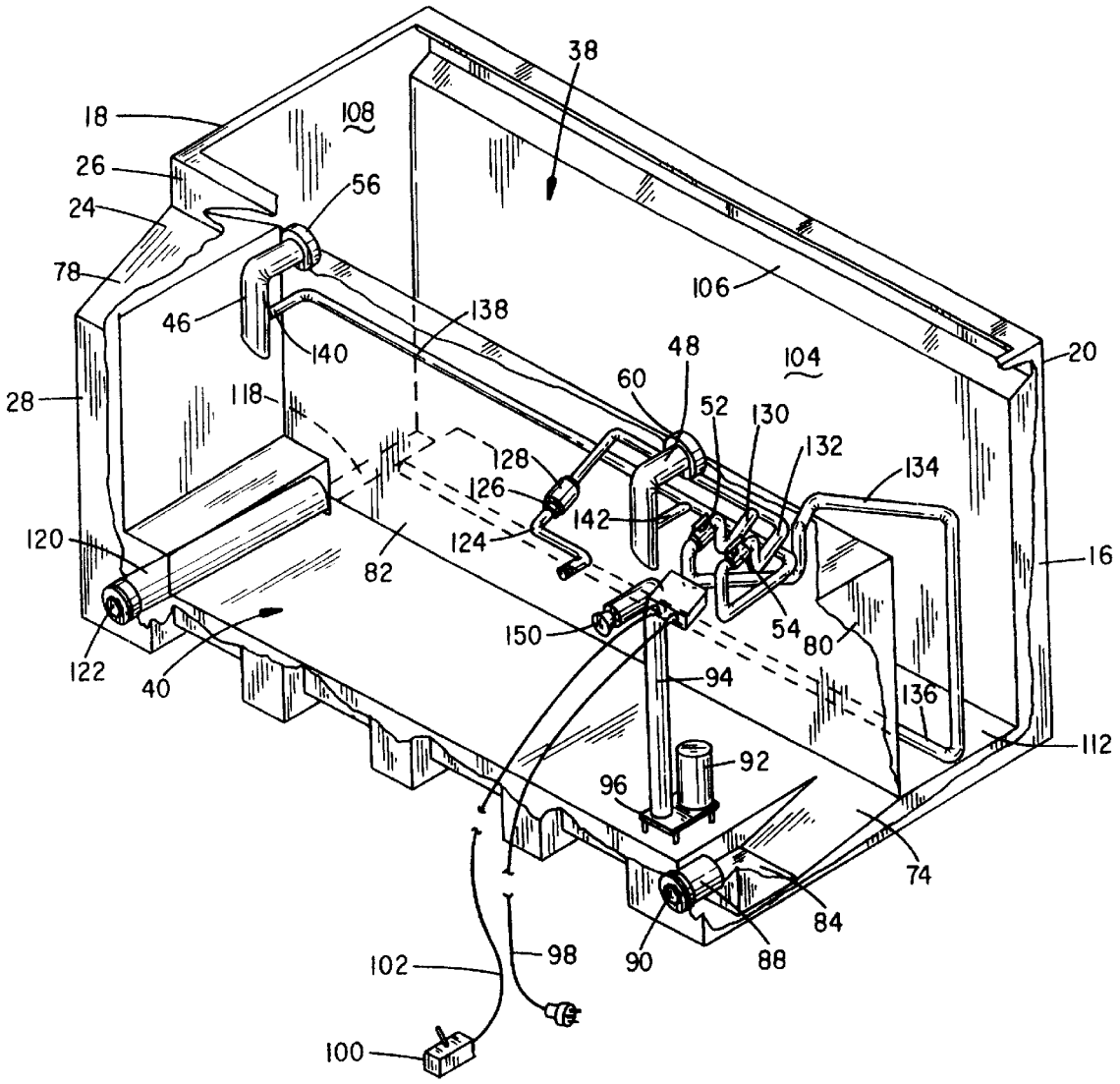
FIG. 3 is a front perspective view with a front and side walls of FIG. 1 removed showing the interior of the dual-tank arrangement and the plumbing of the present invention.

The method of producing the desired solution will now be described. All valves must be turned off and hopper tank 38 is filled approximately two-thirds full with road salt or CMA pellets. The main water in-feed 50 is connected to the water supply (not shown) and the electrical cord 98 is connected to an electric source (not shown). The main water in-feed valve 50 is opened allowing water to enter valve 126. A manual bleed lever 128 located on the body of the valve 126 must be opened until water comes out. This lever 128 may then be closed once it has let off the excess air in the water line. The valve 126 is then opened. After insuring that section line fittings are tight, if a hydraulic float **126*a* is used, as shown in FIG. 5, the length of cord 126*b* on the float 126*a* in the main tank is adjusted, such that valve 126 will close the inlet line 124 when the desired level in holding tank 40 has been reached. The float 126*a* is preferably adjusted so that it is about 4 inches from the top of the holding tank 40 when the holding tank 40 is full. If a conventional hydraulic diaphragm control valve is used, as shown in FIG. 3, it is adjusted to automatically shut off when the solution has reached a desired level in the holding tank 40**.

The inlet valve 52 to the hopper tank 38 is fully opened allowing water to enter the hopper tank 38 through the multi-apertured manifold 136 located below the amount of road salt or CMA pellets. As the hopper tank 38 fills with water, the solution will begin overflowing through the passageway defined by overflow pipes 46 and 48 leading the holding tank 40. The round stainless steel screens 58 and 62 prevent large salt or CMA particles from entering the holding tank 40.

The operator must test the solution flowing into the holding tank 40 to determine the salt percent of the solution. If the percent of salt in the solution is higher than 24%, the infeed valve 52 to the hopper tank 38 is closed halfway. The fresh water in-feed valve 54 is opened and fresh water flows into the dilution line 138, through ports 140 and 142 and into the overflow pipes 46 and 48. The fresh water flowing from pipes 46 and 48 mixes with the solution overflowing from the hopper tank 38. The operator continues testing of the salt percentage and adjusting the fresh water amount being added to the solution flowing from the hopper tank 38. The optimum percentage desired is 23.3% salinity. Once this has been achieved by fine tuning the amount the fresh water flowing into tank 40, the valves 52 and 54 are left in the adjusted position thereby allowing proximally the same saturation percentage to be achieved on the next fill with the same amount of rock salt or CMA pellets in the hopper tank 38.

When the solution has reached the desired level in the holding tank 40, the float switch or hydraulic diaphragm switch 126 shuts the water infeed pipe 124 stopping the flow of water going into the hopper tank 138. The solution is now ready to be pumped into truck tanks. If only one truck tank fill or a single batch is needed, the valve 126 can be turned off, so that the system will not automatically refill itself. If more solution is needed, the valve 126 is left in the on position, allowing the system to automatically refill itself as salt solution is pumped out of the holding tank 40. Thus, the system can be used for either a single batch operation or a continuous production of salt solution on demand.

Pumping the solution into the truck tank can begin. A discharge/fill hose from the truck (not shown) is coupled to the quick disconnect coupling 150. The hose valve can be opened and the discharge valve (not shown) on pump 92 is primed and powered via the pump control 100. Once the truck tank is filled, the remote pump control 100 is used to turn off pump 92. The truck tank discharge/fill hose can be disconnected from the quick disconnect coupling 150. The salt solution can now be spread on roadways, sidewalks, runways and the like.

When it is desired to drain and clean the hopper tank 38, plug 122 on drain pipe 120 is removed and the hopper tank contents and/or water used to flush the hopper tank 38 can be drained out of drain 120. Likewise, when it is desired to drain or clean the holding tank 40, the plug 90 is removed and the holding tank contents and/or water used to clean the holding tank 40 can drain out through drain pipe 88.

This invention has been described herein in sufficient detail in order to comply with the patent statutes and to provide those skilled in the art with the information needed to apply the novel principals and to construct in use such specialized components as are required. However, it is to be understood that the invention can be carried out by specifically different equipment and devices that various modifications, both as to the equipment and details and operating procedures, can be accomplished without departing from the scope of the invention itself.

What is claimed:

1. An apparatus for producing a salt solution suitable for use as in snow and ice removal, said apparatus comprising:

(a) a first plastic container for holding a soluble salt;

(b) a second plastic container for holding a salt solution;

(c) a fluid passageway leading from said first container to said second container, said fluid passageway constructed of a plastic material;

(d) a fresh water infeed coupled to said first container and said fluid passageway.

2. An apparatus of claim 1 and further including an outlet port on said second container.

3. An apparatus of claim 1 and further including a pump operably coupled to said second container.

4. An apparatus of claim 1 and further including a screen mechanism positioned between said fluid passageway and said first container.

5. An apparatus of claim 1 wherein said fresh water infeed is coupled to a manifold in said first container, said manifold constructed of a plastic material.

6. An apparatus of claim 5 and further including said manifold positioned proximate a base of said first container.

7. An apparatus of claim 1 and further including a metering mechanism coupled to said fresh water infeed for selectively metering amount of fresh water flowing into said first container.

8. An apparatus of claim 1 and further including a metering mechanism coupled to said fresh water infeed for selectively metering amount of fresh water flowing into said fluid passageway.

9. An apparatus of claim 1 and further including an automatic water infeed stop mechanism for closing said fresh water infeed to said first container and said fluid passageway.

10. An apparatus of claim 1 and further including a third container containing said first and second containers, said third container having a volume greater than a volume of said first container and a volume of said second container.

11. An apparatus of claim 1 and further including a first outlet port proximate a base of said first container.

12. An apparatus of claim 1 and further including a second outlet port proximate a base of said second container.

13. A method of producing a salt solution suitable for use as a liquid de-icer, said method comprising the steps of:

(a) placing a desired amount of soluble salt in a first container constructed of a plastic material;

(b) introducing water into a base of said first container;

(c) adding water in said first container so water with a concentration of said salt flows out of said first container into an overflow conduit located adjacent a top of said first container;

(d) introducing said water with a concentration of said salt from said overflow conduit to a second container, said second container constructed of a plastic material;

(e) testing the concentration level of said salt in said water located in said second container; and (f) adding fresh water to said second container to obtain the desired concentration level of said salt in said water located in said second container.

14. A method of claim 13 and further including the step of metering the amount of water introduced into the first container.

15. A method of claim 13 and further including the step of metering the amount of water added to said overflow conduit.

16. A method of claim 13 and further including the step of removing said water with said concentration of said desired salt from said second tank.

17. A method of claim 16 and further including the steps of flushing the second tank with a cleansing liquid to remove salt residue and particles and draining said cleansing liquid, salt residue and particles through an outlet port.

18. A method of claim 16 and further including the steps of flushing the first tank with a cleansing liquid to remove salt residue and particles and draining said cleansing liquid, salt residue and particles through an outlet port.

* * * * *